United States Patent [19]

Hirsch

[11] Patent Number: 4,573,221

[45] Date of Patent: Mar. 4, 1986

[54] STRAP WITH CONNECTING PART

[76] Inventor: Hermann Hirsch, Hirschstrasse 5, 9021 Klagenfurt, Karnten, Austria

[21] Appl. No.: 633,394

[22] Filed: Jul. 23, 1984

[30] Foreign Application Priority Data

Jul. 21, 1983 [AT] Austria ..... 2676/83

[51] Int. Cl.[4] ..... A41F 3/02

[52] U.S. Cl. ..... 2/338

[58] Field of Search ..... 2/338; 36/50

[56] References Cited

U.S. PATENT DOCUMENTS 2,885,684 5/1959 Dye et al. ..... 2/338 X
4,190,969 3/1980 Baso ..... 36/50

FOREIGN PATENT DOCUMENTS 1557589 9/1969 Fed. Rep. of Germany .
1805030 6/1970 Fed. Rep. of Germany .
587121 4/1977 Switzerland .

*Primary Examiner*—Louis K. Rimrodt
*Attorney, Agent, or Firm*—Young & Thompson

[57] ABSTRACT

A strap consists of a facing portion (6) and a lining (7), made especially of leather or simulated leather and joined together by gluing, sewing, or the like. A connecting part (1) of a rigid material, such as a metal or synthetic resin, is provided on at least one end of the strap, a tension-relief member (4) being arranged between the face material (6) and the lining (7), this tension-relief member being joined to the connecting part by the formation of a loop (5).

7 Claims, 8 Drawing Figures

STRAP WITH CONNECTING PART

The invention relates to a strap consisting of face material and lining wherein the face material and the lining are made especially of leather or simulated leather and are joined together by gluing, sewing, or the like, and wherein a connecting part of a rigid material, such as a metal or synthetic resin, is joined to the strap at at least one end thereof.

Many possibilities have been proposed for joining straps with other parts, for example when connecting watchbands with watchcases. A frequently employed possibility resides in forming a loop at the end of the strap and placing the loop around a web, for example the watch mounting. It has also been proposed to provide connecting parts of a ridig material within straps, which parts are then attached to another object, for example a watchcase. However, it was found that these connecting parts do not hold the strap sufficiently firmly since the glue bond between the strap material and the rigid connecting part is not durable. Besides, the drawback has existed thus far that the connecting part had to extend a very substantial distance into the strap to attain a reasonably secure hold whereby, however, the softness and flexibility of the strap, desirable in watchbands, in particular, was impaired.

The invention is based on the object of providing a secure connection between the connecting part and the strap.

This object has been attained according to the invention by joining a flexible tension-relief member, retained between the top leather and the leather lining of the strap, to a section of the connecting part extending between the top leather and the leather lining.

Thus, in the invention, the connecting part is joined to the strap by way of a flexible tension-relief member. The flexible tension-relief member in no way detracts from the suppleness of the strap and additionally provides the advantage that it serves as tension-relief means and strap reinforcement especially if it is fashioned to extend continuously over the entire length of the strap. However, it is definitely possible to employ a tension-relief member extending, starting with the end of the strap joined to the connecting part, only over a portion of the length of the strap.

The connection established according to this invention between the connecting part and the strap also makes it possible to select the zone of the connecting part extending into the strap to be very short so that the flexibility of the strap is not deleteriously affected. In this context, the provision can be made according to the invention that the connecting part extends into the strap over a fraction of the strap width.

In one embodiment of the invention, the tension-relief member provided is a high tensile strength woven tape, a high tensile strength sheet, or at least one thread extending in the longitudinal direction of the strap, which thread is optionally attached to a support. A suitable support for the thread or threads serving for tension relief can be, for example, a sheet to which the threads are attached.

Various possibilities exist for joining the tension-relief member and the connecting part together. For example, the provision is made within the scope of the invention to attach the tension-relief member with loop formation through an eye of the rigid connecting part arranged between the top material and the lining of the strap.

Another possibility resides in joining the tension-relief member with the connecting member by gluing, welding, mechanical attachment, such as clamping, for example.

According to one embodiment of the invention, the additional provision can be made to glue the tension-relief member between the top material and the lining, the glue bond serving simultaneously for joining top material and lining. Additionally to or in place of a glue bond, the provision can be made to retain the tension-relief member by at least one seam between the top leather and the lining.

Additional details and features of the invention can be seen from the following description of the embodiments illustrated in the drawing wherein.

Figure 1:
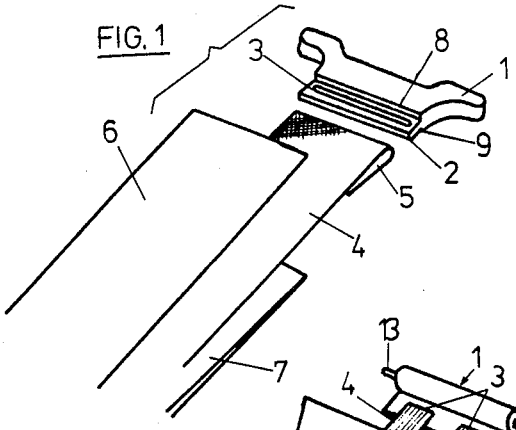
FIG. 1 shows, in an exploded perspective view, a first embodiment.

A connecting part 1 illustrated in FIG. 1 is fashioned as a watch mounting to be attached to a watchcase. This attachment can take place in various ways, for example by means of screws or the like. The connecting part 1 exhibits a transverse slot 3 in a tapered portion 2. A tension-relief member 4, fashioned as a woven tape, is passed through this transverse slot 3 and bent over with the formation of a loop 5. The tension-relief member 4, joined with the connecting part 1 in this way, is inserted between the top leather 6 and the leather lining 7 of a strap and affixed between the top leather 6 and the leather lining 7, for example by gluing and/or by seams. The ends of top leather 6 and leather lining 7 at the side of the connecting part extend up to the shoulders 8 and 9 of the connecting part 1, so that an extensively continuous transition is obtained between the strap and the connecting part 1.

The longitudinal edges of the strap can be partially or entirely bound as known per se from Austrian Pat. No. 252,634.

Figure 2:
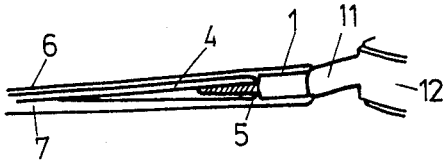
FIG. 2 shows, partially in a longitudinal section, a second embodiment.

In the embodiment shown in FIG. 2, the connecting part 1 is entirely accommodated between the top leather 6 and the leather lining 7. The connection between the connecting part 1 and the tension-relief member 4 is effected, as illustrated in FIG. 1, by means of a loop 5.

Also in the embodiment shown in FIG. 2, the longitudinal edges of the strap can be bound; the binding can extend up into the region of the connecting part 1, so that the connecting part 1 is partly hidden. The connecting part 1 can be joined with the mounting 11 of a watchcase 12, for example, with the use of a spring bar, not shown.

Figure 3:
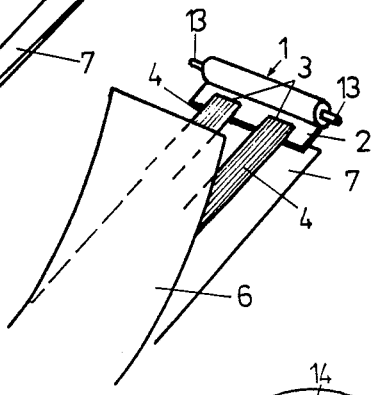
FIGS. 3–5 show various additional embodiments of the connecting part and of the tension-relief member in exploded perspective view.

The connecting part 1 illustrated in FIG. 3 is equipped for attachment to a watchcase, not shown in detail, by means of spring bars 13. The tension-relief member 4 to be inserted and attached, respectively, between the top leather 6 and the leather lining 7 consists, in this embodiment of the invention, of two tapes fastened in transverse slots 3, which latter are arranged in a tapered section 2 connected with the connecting part 1 or fashioned integrally with the latter. The top leather 6 or, respectively, also the leather lining 7 can terminate flush with the section of the connecting part 1 which receives the spring bars 13 and is of a cylindrical shape, for example, or they can also cover this section, for example in the form of a loop.

Figure 4:
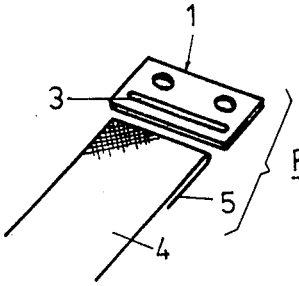

According to the embodiment shown in FIG. 4, the connecting part 1 is fashioned as a metallic component which, in the same way as illustrated in FIG. 1, has a transverse slot 3 through which is extended a tape-like tension-relief member 4 with the formation of a loop 5 and is attached by closing the loop 6.

Figure 5:
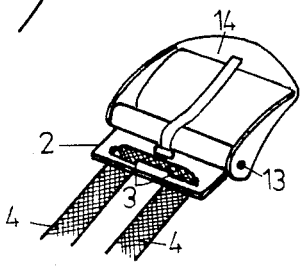
Figure 6:
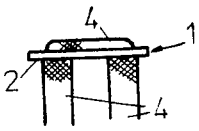
FIG. 6 shows a detail of FIG. 5, and FIGS. 7 and 8 show two modified embodiments of the connecting part and of the tension-relief member, likewise in exploded perspective views.

FIGS. 5 and 6 show an embodiment, similar to FIG. 3, of a connecting part 1 with spring bars 13 and a tapered portion 2 with transverse slots 3 for passing a band-shaped tension-relief member 4 therethrough, but in this case with one-piece threading. The connecting part, according to this embodiment, serves for the connection of a strap, not shown in detail, with a fastener 14, for example a spur fastener.

Figure 7:
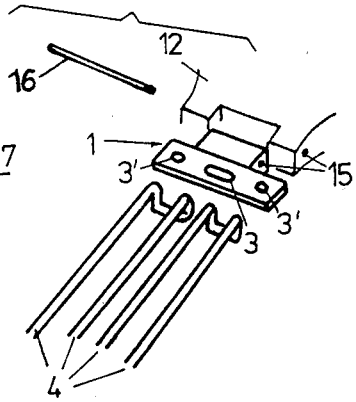

FIG. 7 shows an embodiment wherein a metallic part is provided as the connecting part 1; this part can be joined to the watchcase 12 with the use of bores 15 and a pin 16. The tension-relief member 4 is constituted by threads which are threaded through a transverse slot 3 in the connecting part 1 and/or through bores 3'.

Figure 8:
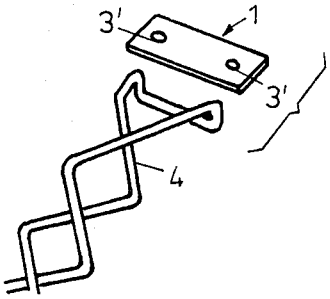

FIG. 8 shows an embodiment wherein again threads are arranged as the tension-relief member 4; these threads are threaded through the connecting part 1 in bores 3' and are inserted in intersecting fashion in the strap between the top leather and leather lining thereof, which are not shown in detail.

I claim:

1. In a strap consisting of face material and lining wherein the face material and the lining are separate pieces of leather or simulated leather and are joined together, and wherein a connecting part of a rigid material, such as a metal or synthetic resin, is joined to the strap at at least one end thereof; the improvement comprising a flexible tension-relief member (4) affixed between the face material (6) and the lining (7) of the strap and connected with a section of the connecting part (1) extending between the face material (6) and the lining (7).

2. Strap according to claim 1, wherein the connecting part (1) extends into the strap over a fraction of the width of the strap.

3. Strap according to claim 1, wherein the tension-relief member (4) provided is a high tensile strength woven tape, a high tensile strength sheet, or threads extending in the longitudinal direction of the strap, which threads are optionally attached to a support.

4. Strap according to claim 1, wherein the tension-relief member (4) is attached with loop formation through an eye of the rigid connecting part, which eye is arranged between the face material (6) and the lining (7) of the strap.

5. Strap according to claim 1, wherein the tension-relief member (4) is joined to the connecting part (1) by gluing, welding, mechanical attachment, such as clamping, for example.

6. Strap according to one of claim 1, wherein the tension-relief member (4) is glued in between the face material (6) and the lining (7), the glue bond serving simultaneously for connecting the face material and the lining.

7. Strap according to claim 1, wherein the tension-relief member is affixed between face material (6) and lining (7) by at least one seam.

* * * * *